US005298337A

United States Patent [19]

Hendricks

[11] Patent Number: 5,298,337

[45] **Date of Patent: * Mar. 29, 1994**

[54] PERFORATED PLATES FOR CRYOGENIC REGENERATORS AND METHOD OF FABRICATION

[75] Inventor: John B. Hendricks, Huntsville, Ala.

[73] Assignee: Alabama Cryogenic Engineering, Inc., Huntsville, Ala.

[ * ] Notice: The portion of the term of this patent subsequent to Apr. 7, 2009 has been disclaimed.

[21] Appl. No.: 800,220

[22] Filed: Nov. 27, 1991

Related U.S. Application Data

[63] Continuation-in-part of Ser. No. 530,873, May 29, 1990, which is a continuation-in-part of Ser. No. 375,709, Jul. 5, 1989, Pat. No. 5,101,894.

[51] Int. Cl.[5] ..... H01F 3/04; B22F 5/00

[52] U.S. Cl. ..... 428/566; 428/569; 29/890.034

[58] Field of Search ..... 29/890.034; 428/566, 428/569

[56] References Cited

U.S. PATENT DOCUMENTS

| | | | |
|---|---|---|---|
| 3,692,099 | 9/1972 | Nesbitt et al. | 165/10 |
| 3,852,045 | 12/1974 | Wheeler et al. | 29/182 |
| 4,004,615 | 1/1977 | Stern et al. | 29/183.5 |
| 4,014,968 | 3/1977 | Simon | 165/8 X |
| 4,118,339 | 10/1978 | Latos | 252/417 |
| 4,343,604 | 8/1982 | Minjolle | 29/425 X |
| 4,645,700 | 2/1987 | Matsuhisa et al. | 165/10 X |
| 5,101,894 | 4/1992 | Hendricks | 29/890.034 X |

*Primary Examiner*—Peter A. Nelson
*Attorney, Agent, or Firm*—Phillips & Beumer

[57] ABSTRACT

Perforated plates (10) having very small holes (14) with a uniform diameter throughout the plate thickness are prepared by a "wire drawing" process in which a billet of sacrificial metal is disposed in an extrusion can of the plate metal, and the can is extruded and restacked repeatedly, converting the billet to a wire of the desired hole diameter. At final size, the rod is then sliced into wafers, and the wires are removed by selective etching. This process is useful for plate metals of interest for high performance regenerator applications, in particular, copper, niobium, molybdenum, erbium, and other rare earth metals. $Er_3Ni$, which has uniquely favorable thermophysical properties for such applications, may be incorporated in regions of the plates by providing extrusion cans (20) containing erbium and nickel metals in a stacked array (53) with extrusion cans of the plate metal, which may be copper. The array is heated to convert the erbium and nickel metals to $Er_3Ni$. Perforated plates having two sizes of perforations (38, 42), one of which is small enough for storage of helium, are also disclosed.

22 Claims, 4 Drawing Sheets

PERFORATED PLATES FOR CRYOGENIC REGENERATORS AND METHOD OF FABRICATION

ORIGIN OF THE INVENTION

This invention was made with government support under Contract No. DE-FG05-90-ER81018 awarded by the Department of Energy. The government has certain rights in the invention.

CROSS REFERENCE OF RELATED APPLICATION

This application is a continuation-in-part of U.S. application Ser. No. 07/530,873, filed May 29, 1990, which is a continuation-in-part of U.S. application Ser. No. 07/375,709, filed Jul. 5, 1989, now U.S. Pat. No. 5,101,894.

FIELD OF THE INVENTION

This invention relates to perforated plates for cryogenic regenerators and to methods of fabricating such plates.

BACKGROUND OF THE INVENTION

Regenerators are periodic-mass-flow heat exchangers in which a fluid is periodically pumped back and forth through a matrix. During one part of a flow cycle, the matrix absorbs heat from the fluid, and when flow is reversed, heat is transferred from the matrix to the fluid. Two key factors in operation of these devices are the heat exchange between the fluid and the matrix and the heat storage capacity of the matrix. These factors can be characterized by numerical coefficients as follows:

(a) heat exchange-hA (b) heat storage-C where h is the heat transfer coefficient (SI units-watts/$m^2$.K), A is the heat transfer area (SI units-$m^2$), and the C is the matrix heat capacity (SI units-Joules/kg.K).

There are two additional secondary factors for regenerator operation, namely, pressure drop ($\Delta P$) (SI units for pressure-Pa) across the regenerator due to frictional losses and void volume (VV) (SI units for void volume-$m^3$) of the regenerator. The pressure drop must be overcome in order to drive the fluid through the regenerator. This requires work, and this work is not recoverable, so that it is a loss to the cycle. The void volume of the regenerator causes the output mass flow of the regenerator to be less than the input mass flow. The difference is required to "fill" the void volume. In addition, it means that all the mass flow does not flow entirely through the regenerator. Some fraction of that will only traverse a part of the regenerator, and this part will undergo a partial heat exchange process.

In an "ideal" case, the value of hA will be very large when compared to the capacity rate, ($mc_p$) of the fluid. Here m is the mass fluid flow, and $c_p$ is the heat capacity of the fluid (SI units: m-kg/sec; $c_p$-Joules/kg.K). In the ideal case the value of the matrix heat capacity, C, must be large when compared to the product $\tau mc_p$ where $\tau$ is the "blow" period or a period of time between flow reversals (SI units-sec). In this ideal case, the void volume and pressure drop will be zero. It is impossible to build the ideal regenerator described above since the factors are interrelated. Therefore, all practical regenerators will have pressure drop and void volume. The problem for the regenerator designer is to obtain the necessary values of heat transfer and heat storage, while minimizing the effect of pressure drop and void volume. Previous design efforts have developed a number of different analytical techniques. These techniques must also consider the overall system in which a regenerator is used. However, regardless of the application, certain things are always desirable. These include:

a. for a given heat exchange, the pressure drop and void volume should be minimized; or, conversely, for a given pressure drop and void volume, the heat exchange should be maximized.

b. the matrix heat capacity must be large enough to keep the temperature swing during a blow period to a small value.

In order to produce very high efficiency regenerators, it is not sufficient simply to provide high thermal capacity material. The material must also be incorporated in an optimum geometry that provides a most effective heat exchange per unit void volume and at the lowest possible pressure drop. Three possible regenerator matrix geometries have been considered and subjected to analysis to determine their relative efficiencies. These regenerators include:

(1) crossed rod or wire screens, (2) randomly packed sphere beds, and (3) perforated plates.

For this analysis to be valid, certain characteristics are required in the perforated plates, in particular, each perforation must have a uniform cross section throughout its length, and the "entry" and "exit" of the perforations must have a sharp right-angle shape. Further considerations are as follows: The "friction factor" and "Stanton number" of tubes with a circular cross section depend on the length-to-diameter ratio (L/D); tubes with a rectangular cross section approach the performance of parallel plates and do not depend on the L/D ratio; and the performance of circular cross section tubes with relatively small L/D approaches that of parallel plates.

Comparisons of heat transfer performance have been made for three study cases:

(1) perforated plates versus sphere beds for equal pressure drops and identical regenerator dimensions, (2) perforated plates versus screens for equal pressure drops and identical regenerator dimensions, and (3) perforated plates versus screens for equal pressure drops, equal regenerator void volumes, and equal regenerator lengths.

The results obtained show that:

(1) perforated plates provide at least a sixfold improvement in performance over packed sphere beds, (2) for equal regenerator volume, perforated plates are better than wire mesh screens for some ranges of Reynolds numbers, and (3) for equal void volume, perforated plates are superior to wire mesh screens at all Reynolds numbers.

Predictions of regenerator performance may be made using average temperature values along the entire length of the regenerator. A preferred approach, however, is to section the regenerator and use average values for each section. This requires a knowledge of the temperature gradient along the length of the regenerator, taking into account two main temperature effects: (1) the thermal conductivity of the fluid decreases at lower temperatures so that smaller flow passages are required at low temperatures if effective heat transfer is to be maintained, and (2) the volumetric heat capacity of the matrix decreases at low temperatures, requiring more matrix material.

The regenerator matrix material must be in thermal contact with the fluid in order to be useful. This means that the thermal penetration length, that is, the distance the temperature wave propagates into the matrix, must be long enough that the entire matrix participates in the heat transfer process. For sinusoidal temperature variation, the thermal penetration depth is given by:

$$\lambda = \left[\frac{k}{\rho c_p \pi \nu}\right]^{\frac{1}{2}}$$

where k, $\rho$, and $c_p$ are the matrix thermal conductivity, density, and specific heat, respectively, and $\mu$ is the operating frequency. Thus, both a high specific heat and a high thermal conductivity are required to make full use of the matrix heat capacity. This can severely limit the choice of materials.

While the higher efficiency of perforated plates with defined hole geometry is clear, a practical method of fabricating such plates has not been available, particularly at the hole sizes and extent of perforation volume desired for operation of high-performance regenerators at liquid helium temperatures. Hole diameters ranging from 300 microns down to below 1 micron and an open porosity value of 30 to 40 percent of the plate area may be required for specific regenerators, with smaller holes and porosities being required for lower operating temperatures.

Perforated plates for use in various types of heat exchangers are disclosed in prior patents. Hoffman in U.S. Pat. No. 3,273,357, issued Sep. 20, 1966, discloses perforated plates with eight mil diameter holes formed by die cutting or photoetching. U.S. Pat. No. 3,692,099, issued Sep. 19, 1972, to Nesbitt et al. discloses plates with eight mil diameter holes, which are said to be formed by any conventional methods through drilling, punching, etching, or use of sintered matrices of spheres, chips, or wires. U.S. Pat. No. 3,228,460, issued Jan. 11, 1966, to Garwin, shows perforated plates with 15 mil diameter holes but does not disclose how the holes are formed. At the hole sizes of interest for high-performance cryocoolers, that is, from below 1 to 300 microns in diameter, conventional methods as disclosed in these patents are ineffective in that holes produced by these methods do not have a uniformity of shape along their length as required for maximum efficiency. Mechanical methods such as drilling or punching are not practical at these sizes because drills or punches of such sizes are not available and because of the large number of holes required. Photoetching through a mask results in holes of non-uniform shape along their length owing to underetching or other effects that produce curved or inclined, rather than straight, hole walls through the depths of the plate.

Another important factor in the design of high-performance regenerators is the selection of a plate material having optimum thermal properties for the temperature range of operation, in particular, a high specific heat at a selected temperature, consistent with a high thermal conductivity, amenability to fabrication, and reasonable cost. At above 50° K., copper, brass, and 304 stainless steel meet these requirements; at 20 to 50 K, erbium and lead have the highest volumetric heat capacity, and below 20 K, helium and materials with magnetic transitions, in particular GdRh, $GdEr_x Rh_{1-x}$, $Er_3Ni$ and other rare earth alloys have a favorable high heat capacity. Any alloy containing a precious metal such as rhodium would be too expensive. Many of the rare earths are relatively expensive; however, when fabrication costs are included, the cost of some of these materials, in particular $Er_3Ni$, would not be prohibitive for high performance applications.

Japanese investigators have performed work on regenerative cryocoolers for use at liquid helium temperatures. (Proceedings of the Sixth International Cryocooler Conference held in Plymouth, Mass., Oct. 25, 1990). This work is directed to regenerators using $Er_3Ni$ as a heat exchanging material, this compound being selected because of its uniquely high specific heat at temperatures from 3° K. to 20° K. However, it is a brittle intermetallic compound not amenable to fabrication into perforated plates using known methods. The $Er_3Ni$ in this work was provided in the form of 0.6 mm spheres in a packed bed. Such a geometry does not enable the potentially high performance of this material to be realized. Much better performance would be available if perforated plates of $Er_3Ni$ with controlled pore geometry would be made.

In addition to providing perforated plates made of selected metals or intermetallic compounds, it is desired to provide a method of fabricating composite plates which would incorporate inclusions of a plate material contained at predetermined locations in a matrix of a first material. The matrix of such a plate would provide the thermal conductivity needed for good heat transfer, and the inclusions would provide the high heat capacity needed for good thermal storage. No method is available for fabricating plates with such a structure. Another desired approach would be to provide perforated plates which include some perforations that would entrap helium and thus take advantage of the high heat capacity of helium.

SUMMARY OF THE INVENTION

The present invention is directed to perforated plates having very small holes with a uniform diameter throughout the thickness of the plate and to a method of fabricating plates with these characteristics. The matrix of the plate may comprise a metal, an intermetallic compound, or a composite having inclusions distributed in the plate in a predetermined pattern. The metal or other material of the plate is selected to provide desired thermophysical properties at a specific temperature range, in particular, high specific heat consistent with other criteria.

Fabrication of perforated plates according to the present invention may be carried out by means of a "wire drawing" process involving a series of stacking and drawing or extrusion steps. In each step, sacrificial wire material is disposed lengthwise in an extrusion can and is surrounded by the desired plate material to form a billet. The billet is initially extruded and then restacked and drawn repeatedly, with the wire material being thinned out by each cycle. When the desired wire diameter is reached, the wire-containing billet is cut into plates and then selectively etched away, leaving perforated plates.

For fabrication of plates with inclusions of brittle material such as $Er_3Ni$, which is not amenable to extrusion, the process may be carried out by extruding and drawing a mixture including ductile metal precursors to obtain an extruded metal body and converting the metals therein to the intermetallic compound in a subsequent in-situ heating step. Composite plates may be fabricated by placing rods of inclusion material into the stacked billet at predetermined locations, with the relative area of these rods as compared to rods of the matrix metal being selected to provide a desired proportion in the plates.

Perforated plates having a structure in which helium may be entrapped in a selected portion of the perforations are provided in another embodiment of the invention. The entrapped helium functions as a part of the matrix, providing a high heat capacity.

Perforated plates embodying the invention may have a selected hole diameter in the size range of interest for high performance cryocooler applications, in particular from under 1 micron to 300 microns, with the holes being uniform in diameter throughout their length. The plates may comprise a single metal, an intermetallic compound, or metal composites with inclusions at predetermined locations. Metals or other plate material would be selected for optimum performance at specified temperature ranges. The fabrication process provides flexibility for producing plates of different desired materials or combination of materials by varying the manner in which the materials are assembled in the extrusion can. The process further enables fabrication of $Er_3Ni$ in perforated plate form so that its specific heat characteristics may be utilized to full advantage in an optimum geometric configuration.

It is therefore an object of this invention to provide perforated plates for regenerative heat exchangers, the plates having tubular holes of uniform diameter throughout their thickness.

Another object is to provide perforated plates made of a selected metal, an intermetallic compound, or a metal composite.

Yet another object is to provide a perforated plate of $Er_3Ni$.

Another object is to provide perforated plates made of a high thermal conductivity metal, with a portion of the perforations therein having a capability for entrapment and storage of helium.

Another object is to provide a process for fabricating such perforated plates.

Still another object is to provide perforated plates for use in cryocoolers operating at liquid helium temperatures.

Other objects and advantages of the invention will be apparent from the following detailed description and the claims appended thereto.

DESCRIPTION OF THE PREFERRED EMBODIMENT

Figure 1:
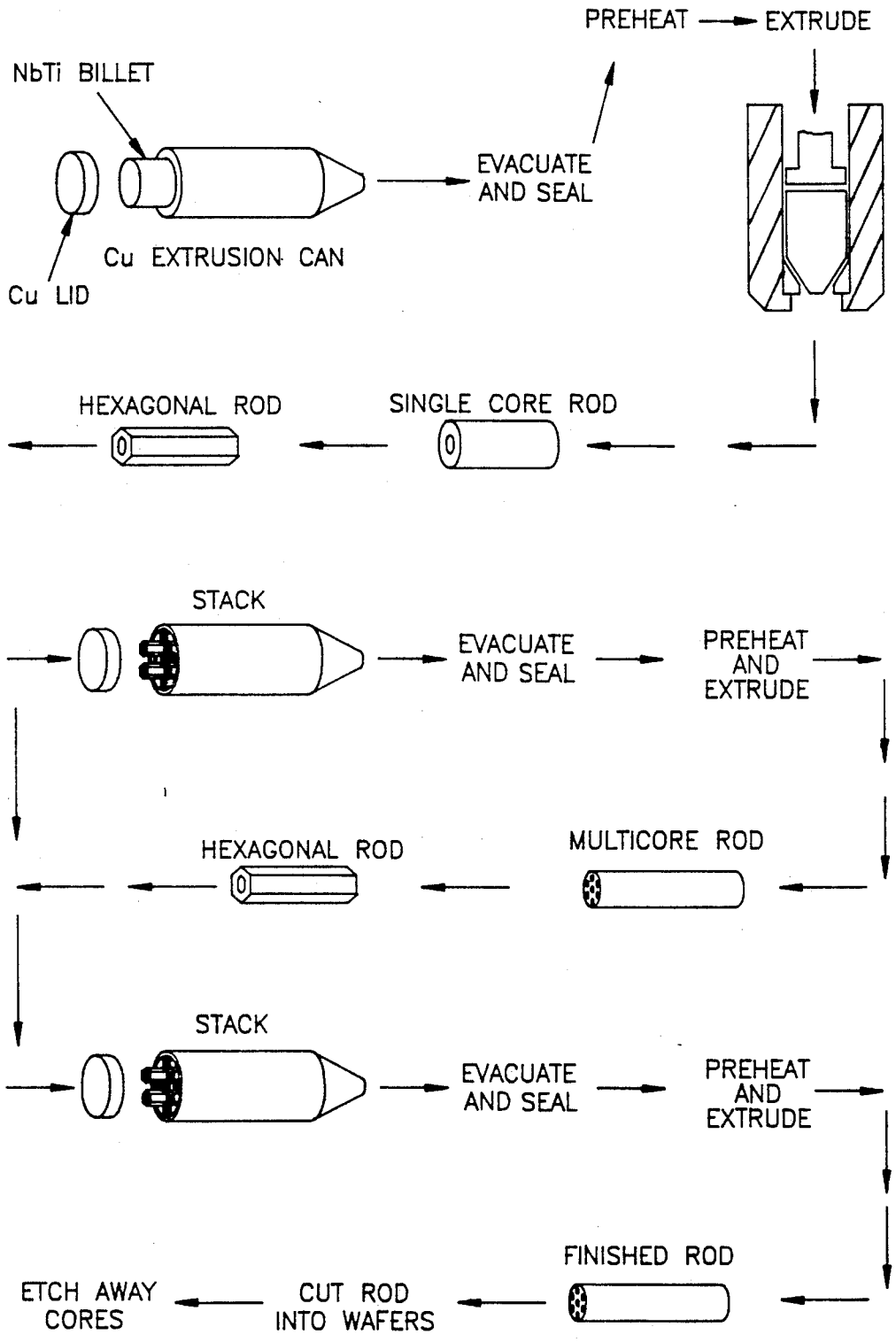
FIG. 1 is a schematic view illustrating the process of the invention.

Referring to FIG. 1 of the drawings, preparation of perforated plates by the process of this invention is schematically illustrated, the plate material in this instance being copper. A generally cylindrical extrusion can, conical at one end, is made up of copper and a cylindrical billet of sacrificial niobium-titanium alloy is placed inside the can. A lid of copper is then fitted over the flat end of the can, and the assembly is evacuated and sealed by welding. The sealed can is preheated to a temperature of at least 400° C. and extruded through a die to obtain an elongation of 50 percent or more. An extruded cylindrical rod made up of niobium-titanium core surrounded by copper is produced in this step. Subsequent size reductions may be carried out by extrusion in which the rod is pushed through a die or by drawing in which the rod is pulled, but drawing is preferred after the initial size reduction. In order to enable stacking of an array of single core rods, the rods are then converted to hexagonal shape as shown by drawing through a hexagonal die or machining as required. The hexagonal single core rods are then stacked within a cylindrical copper can, and the can is provided with a lid and is subjected to preheating and re-extrusion in the same manner as for the starting billet. Repeated sequences of extrusion or drawing, conversion to hexagonal shape and stacking are carried out until the billet material is thinned out to a desired diameter. At this point, the finished rod is cut into wafers, giving a desired plate thickness. The sacrificial material is etched away by hydrofluoric acid, leaving a matrix of copper with a multiplicity of small diameter holes having a uniform cross section throughout the plate thickness.

The process illustrated above for preparation of copper plates may be applied to other metals of interest for perforated plate heat exchangers, in particular, niobium, molybdenum, nickel, erbium, and other rare earth metals.

In each case, a plate metal would be formed into an extrusion can, and a billet of a selected sacrificial metal would be placed in the can, the sacrificial material being selected for its capability for being etched away without affecting the matrix of the plate. Niobium or a niobium-titanium alloy is preferred for copper plates because of its capability for being selectively etched away by hydrofluoric acid and because of its availability. For niobium plates, copper may be used as the sacrificial metal and nitric acid as the etchant. For molybdenum plates, niobium or a niobium alloy may be used as the sacrificial metal and hydrofluoric acid as the etchant. For erbium, $Er_3Ni$, or other rare earth metals, niobium or a niobium alloy may be used as the sacrificial metal and hydrofluoric acid as the etchant.

Constraints on the combinations of metals which may be used are imposed by the nature of the process. In order to undergo extrusion, the metal must exhibit some degree of ductility and malleability, and the individual metals of the selected combinations must be compatible with one another and not subject to gross formation of undesirable intermetallic compounds under process conditions. In addition, the plate metal must be resistant to being attacked by the etchant used to remove the sacrificial material. These considerations also apply to preparation of plates including inclusions of a second metal or desired intermetallic compound as will be described below.

Figure 2:
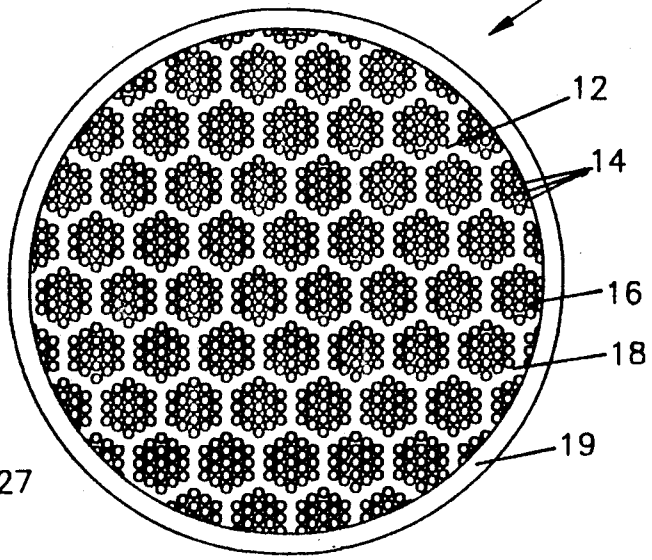
FIG. 2 is a top planar view of a perforated plate embodying the invention.

FIG. 2 shows a single metal perforated plate 10 made up of copper by the process shown in FIG. 1. The plate has a metal matrix 12 penetrated by a multiplicity of perforations 14 spaced throughout the plate in hexagonal groups 16 separated from one another by a solid region 18, which pattern results from stacking of hexagonal rods in the preparation process. The perforations have a highly uniform spacing and dimensions and in particular have a uniform cross section throughout their lengths, which characteristic is essential to effectiveness of the plates in high performance regenerative cryocooler applications.

Perforation diameters and the overall extent of open area through the plates may be provided over a wide range of values, including those desired for cryocooler applications that require an open area from less than one to greater than 40 percent and hole diameters from less than one to greater than 300 microns. Plate thicknesses may be obtained as desired by varying the spacing of transverse cuts in cutting the rod into wafers. For high performance cryocoolers, a thickness of 0.1 to 2 mm would typically be used. The plate has a rim 19 of copper around its outer circumference, which may be clad over the rod to provide a fully perforated structure adjacent to the rim.

Figure 3A:
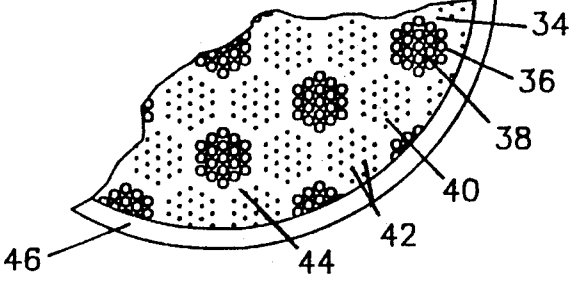
FIG. 3*a* is a sectional view showing a perforated plate having a matrix penetrated by hexagonal-shaped groups of different-sized perforations.
Figure 3:
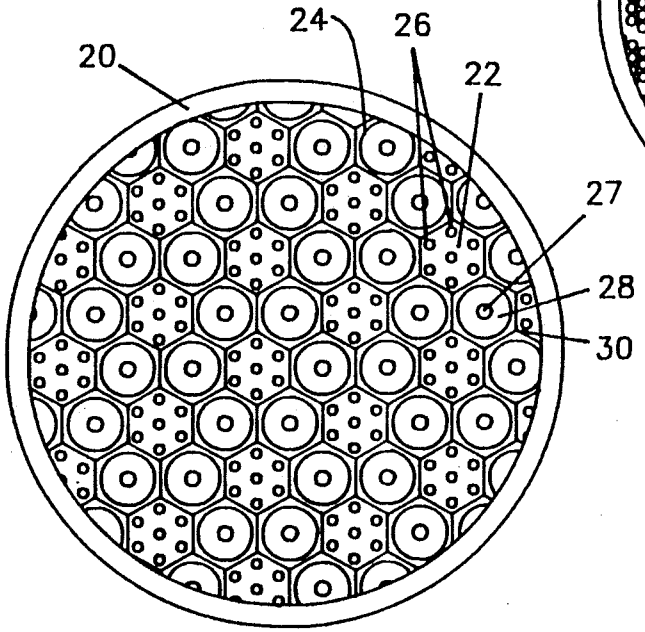
FIG. 3 is a top planar view of an array of hexagonal elements assembled for extrusion.
Figure 5:
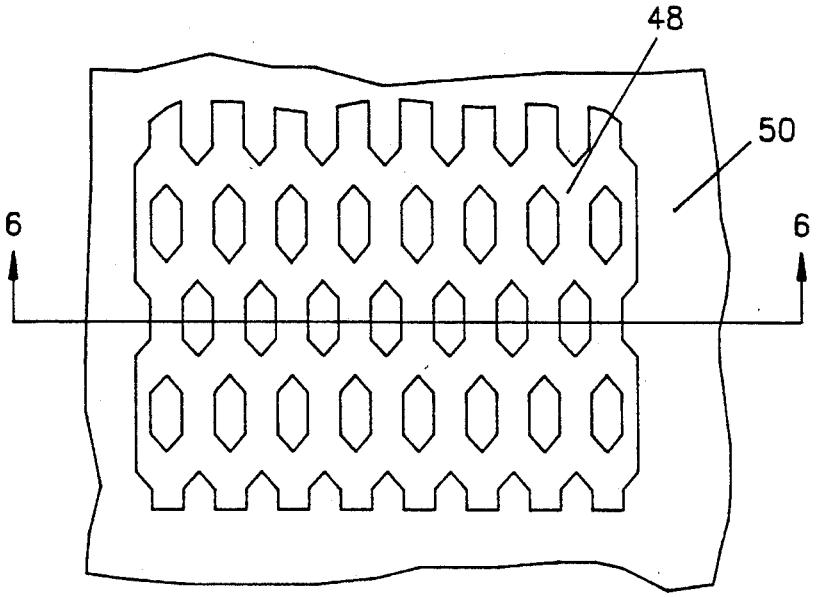
FIG. 5 is a top planar view of the metal sheets of FIG. 4 prior to being rolled up.
Figure 6:
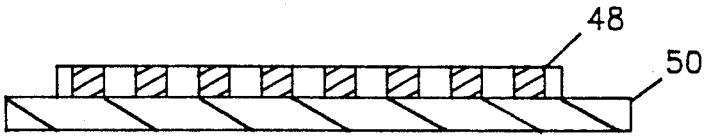
FIG. 6 is a sectional view taken through line 6—6 of FIG. 5.
Figure 4:
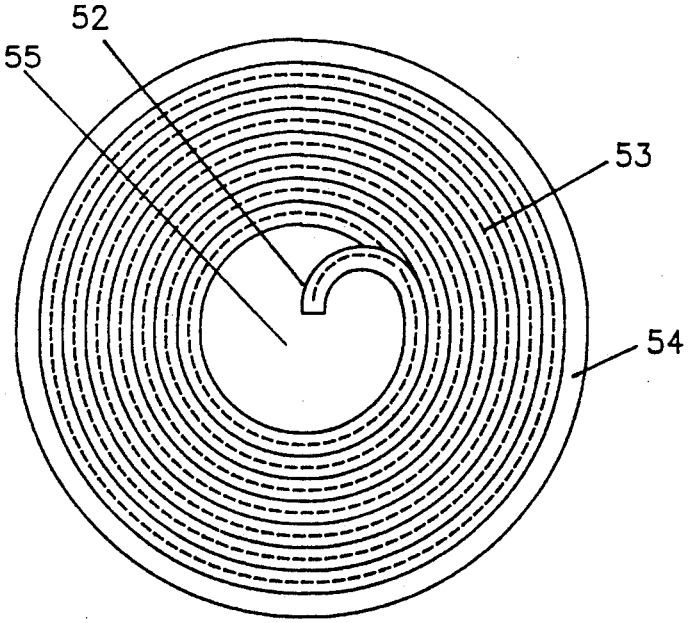
FIG. 4 is a cut-away view showing sheets of different metals rolled up around a mandrel for extrusion.

FIGS. 3-6 show an embodiment wherein ErNi is incorporated in regions of a composite perforated plate by first forming an extruded structure containing precursor erbium and nickel metals and subsequently heating the composite structure to cause the metals to react with one another, forming the intermetallic compound. The view shown in FIG. 3 depicts hexagonal rods of copper 22 and hexagonal rods 24 containing erbium and nickel stacked in an extrusion can 20, as seen from an end thereof. Copper rods 22 have sacrificial wires 26 extending longitudinally and thinned out by previous extrusion or drawing and restacking steps as described above. Rods 24 are made up of a copper mandrel 55 surrounded by a layered array 53 of erbium and nickel metal sheets wrapped around the mandrel, with an edge portion 54 of copper. The two types of rods are distributed throughout the assembly in an alternating uniform pattern as shown.

In preparation of rods 24, a sheet of nickel mesh 48 is placed over a sheet 50 of erbium foil, with the relative amounts of these metals being adjusted to provide stoichiometric quantities for preparation of $Er_3Ni$. An edge of the stacked sheets are then engaged in a longitudinal slot 52 in the mandrel, and the sheets are wrapped in "jelly roll" fashion. Placement of the sheets in this manner provides for intimate contact and facilitates their reaction to form $Er_3Ni$. The mandrel and wrapped sheet assembly is then placed in a copper can 30 for extrusion, conversion to hexagonal shape and stacking between copper rods 22. Repeated cycles of extrusion or drawing and restacking may be carried out until a wire diameter corresponding to a desired perforation diameter is obtained. At that point, the resulting composite rod is heated to convert the erbium and nickel to $Er_3Ni$. Heating at a temperature above the $Er_3Ni$ eutectic (880° C.) is required in this step. The rod is then sliced into wafers of a desired plate thickness, and the wafers are etched with hydrofluoric acid to remove the sacrificial wire. Composite perforated plates made according to this embodiment may have characteristics of particular interest for cryogenic regenerators, in particular, an $Er_3Ni$ content of 20 to 65 percent, an open area of 2 to 20 percent, and a perforation diameter of 10 to 300 microns.

FIG. 3*a* shows a perforated plate 32 having a matrix 34 penetrated by hexagonal-shaped groups of different-sized perforations. Hexagonal groups 36 are penetrated by a plurality of holes 38 sized to allow passage of gaseous helium working fluid. Groups 40 have extremely small, submicron-size holes 42 which entrap and store helium so that the stored helium enhances the heat capacity of the plate. The groups are arranged in a uniform pattern, separated from one another by solid regions 44, and a solid rim 46 is provided around the edge of the plate. This structure is obtained by first preparing hexagonal rods corresponding to groups 40 by repeated cycles of extrusion or drawing and stacking as described above and stacking the resulting rods having inclusions of wires of a very small diameter alongside hexagonal rods corresponding to groups 36, the two types of rods being stacked in a pattern as shown in FIG. 3. The stacked assembly is then subjected to at least one extrusion or drawing step to produce a continuous matrix. Slicing the resulting rod into wafers and etching away of the wires may be carried out as described above. For typical applications, perforations 42 may have a diameter of 0.6 to 0.8 microns and holes 38 of a diameter of 10 to 30 microns. Copper is the preferred plate material for this embodiment.

Figure 8:
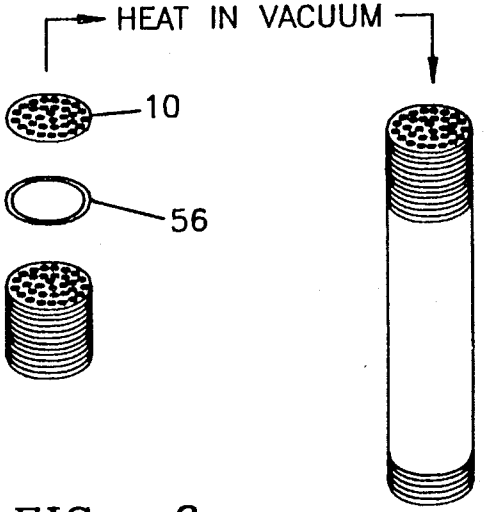
FIG. 8 is a schematic view showing another embodiment for fabricating a heat exchanger.
Figure 7:
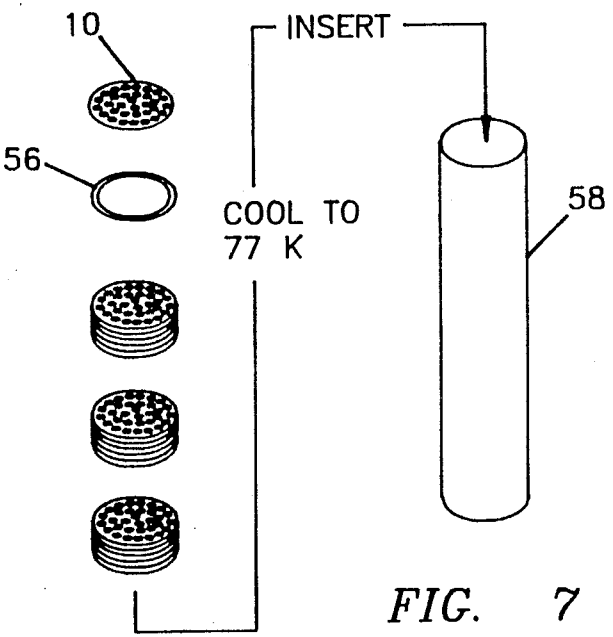
FIG. 7 is a schematic view illustrating one embodiment for fabricating perforated plates into a heat exchanger.

FIGS. 7 and 8 illustrate methods of fabricating regenerators using perforated plates embodying the invention. The plates 10 are disposed in a stacked array, alternating with spacers 56. In the method shown in FIG. 7, the stacked array is cooled to a temperature of 77° K. and inserted into a tubular metal housing 58, which is held at room temperature. Upon warming up, the plates and spacers expand to fit tightly against the housing wall. This method may be used for regenerators using copper plates, stainless steel spacers, and a stainless steel housing. As shown in FIG. 8, the stacked array of plates and spacers may be joined together to form an integral body by heating in vacuum to effect diffusion bonding. For copper plate and stainless steel spacers, heating to a temperature of 900° C. for 30 minutes is preferred. The plates and spacers may also be joined by brazing, with braze preforms being inserted between each plate and the adjacent spacer.

Figure 9:
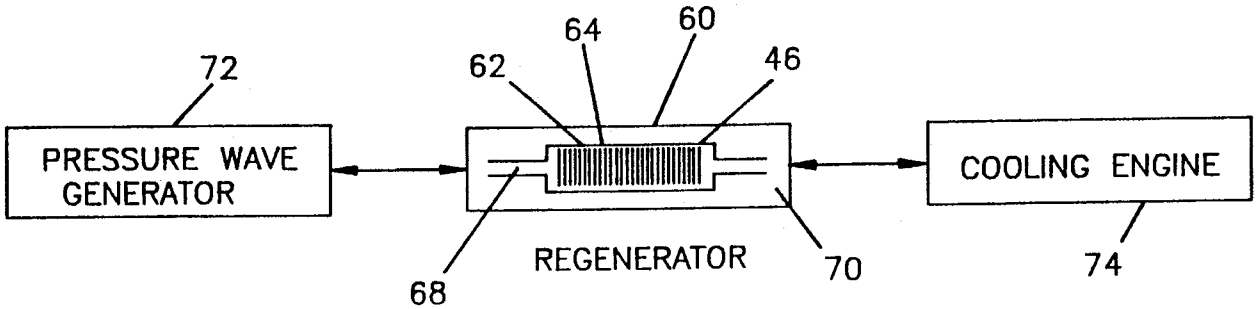
FIG. 9 is a schematic view showing a regenerator embodying the invention.

FIG. 9 schematically illustrates operation of a regenerator 42 embodying the invention. The regenerator has a stack of perforated plates 62 alternating with spacers 64 disposed within a tubular housing 66 provided with fluid inlets/outlets 68, 70 at each end of the housing. A fluid such as liquid helium is periodically pumped back and forth through the housing by pressure wave generator 72. In one part of the flow cycle, heat is absorbed from the fluid by the matrix of the plates and in the reverse part of the cycle heat transferred back to the fluid. Periodic expansion of the fluid generates a cooling effect, removing heat from cooling engine 54.

While the invention is described above in terms of specific embodiments, it is to be understood as limited thereby, but is limited only as indicated by the appended claims.

I claim:

1. A process for making perforated plates having holes with a uniform diameter throughout the thickness thereof which comprises:

providing a first extrusion can of a selected plate metal;

disposing a cylindrical billet of a selected sacrificial metal within said can and in axial alignment with the can;

extruding or drawing the billet-containing can whereby the can and billet are elongated and reduced in diameter;

stacking a plurality of reduced-diameter, extruded or drawn billet-containing cans in a second extrusion can of said plate metal, with the extruded or drawn cans in axial alignment with one another and with the second can;

extruding or drawing the second can whereby the sacrificial metal billets therein are further elongated and reduced in diameter to form wires;

repeating said stacking and drawing or extrusion steps a plurality of times until the diameter of said wires is reduced to correspond to a desired perforation diameter;

slicing the resulting final extruded or drawn can perpendicular to the axis thereof to obtain wafers of a desired thickness; and selectively etching the wafers to remove the sacrificial metal wires whereby holes through the wafers are produced.

2. The process as defined in claim 1 including the step of converting each extruded or drawn can into hexagonal shape prior to stacking for re-extrusion.

3. The process as defined in claim 2 wherein the hexagonal extruded or drawn cans have a uniform size and are stacked in a hexagonal array, with sides of the cans in intimate contact along the length thereof.

4. The process as defined in claim 3 including the steps of evacuating and sealing each can prior to extrusion or drawing.

5. The process as defined in claim 4 including the step of preheating each sealed can prior to extrusion or drawing.

6. The process as defined in claim 1 wherein the plate metal is copper or molybdenum and the sacrificial metal is niobium or a niobium alloy.

7. The process as defined in claim 6 wherein the wafers are etched with hydrofluoric acid.

8. The process as defined in claim 1 wherein the plate metal is niobium, the sacrificial metal is copper, and the wafers are etched with nitric acid.

9. The process as defined in claim 1 wherein the plate metal is erbium, the sacrificial metal is niobium or a niobium alloy, and the wafers are etched with hydrofluoric acid.

10. A process for preparing a composite perforated plate comprising a perforated matrix of a selected plate metal and inclusions of $Er_3Ni$ which comprises:

providing a first extrusion can of said plate metal;

disposing a cylindrical billet of selected sacrificial metal in said can in axial alignment with the can;

extruding or drawing the billet-containing can whereby the billet and can are elongated and reduced in diameter;

stacking a plurality of reduced-diameter, extruded or drawn billet-containing cans in a second extrusion can of said plate metal, with the extruded or drawn cans in axial alignment with one another and with the second can;

extruding or drawing the second can whereby the sacrificial billets therein are further elongated and reduced in diameter;

stacking a plurality of extruded or drawn cans containing wires of sacrificial metal having a predetermined diameter in a third extrusion can in alternating relation with elongated solid bodies of the same size as the extruded cans and containing erbiumn and nickel metals in intimate contact with one another;

extruding or drawing said third can whereby said plate metal is merged with said elongated bodies, and said wires are further reduced in diameter;

heating said extruded or drawn third can at a temperature of 565° C. to 800° C. where said erbium and nickel react to form $Er_3Ni$;

slicing the heated can into wafers of a desired thickness; and etching the wafers to remove said sacrificial metal.

11. The process as defined in claim 10 wherein each of said extruded or drawn cans is converted to hexagonal shape prior to being stacked, and said elongated body has a hexagonal shape and dimensions equal to the dimensions of the shaped extruded cans.

12. The process as defined in claim 11 wherein said elongated bodies comprise an axially disposed metal mandrel, alternating sheets of erbium and nickel wound around the mandrel, and an outer containers made of said plate metal.

13. The process as defined in claim 12 wherein said plate metal is copper.

14. The process as defined in claim 13 wherein said sacrificial metal is niobium or a niobium alloy.

15. A perforated plate for a heat exchanger comprising a matrix of a metal selected from the group consisting of copper, niobium, molybdenum, nickel, erbium, and other rare earth metals, said plate being penetrated by a multiplicity of holes having a uniform diameter throughout the plate thickness.

16. The perforated plate as defined in claim 15 wherein said metal is copper.

17. The perforated plate as defined in claim 15 wherein said holes have a diameter of 1 to 300 microns.

18. The perforated plate as defined in claim 17 wherein said plate has an open area of 1 to 40 percent.

19. The perforated plate as defined in claim 17 including $Er_3Ni$ disposed at spaced-apart locations in the matrix of the plate between perforated portions thereof.

20. The perforated plate as defined in claim 15 wherein said holes are formed by etching of sacrificial wires provided in the plate matrix and reduced in diameter by repeated extrusion and stacking steps.

21. The perforated plate as defined in claim 15 including perforations of a first diameter sized to retain helium therein and a second diameter sized to retain helium therein and a second diameter sized to allow passage of a working fluid therethrough.

22. The perforated plate as defined in claim 21 wherein the plate is comprised of copper, the first diameter is 0.6 to 0.8 microns, and the second diameter is 10 to 30 microns.

* * * * *